United States Patent [19]

Lindblom

[11] 4,322,102

[45] Mar. 30, 1982

[54] GUARDED LOCKING DEVICE

[76] Inventor: Erik I. Lindblom, Bjursätragatan 81, S-123 42 Bandhagen, Sweden

[21] Appl. No.: 170,688

[22] Filed: Jul. 21, 1980

Related U.S. Application Data

[63] Continuation of Ser. No. 893,968, Apr. 6, 1978, abandoned.

[30] Foreign Application Priority Data

Apr. 6, 1977 [SE] Sweden ..... 7704006

[51] Int. Cl.[3] ..... E05C 19/08

[52] U.S. Cl. ..... 292/281; 70/2; 70/56; 292/148; 292/282

[58] Field of Search ..... 292/281–284, 292/292, 295, 302, 148, 205; 70/52, 54–56, 416–418, 2, 3, 5, 6, 13

[56] References Cited

U.S. PATENT DOCUMENTS

| | | | |
|---|---|---|---|
| 160,723 | 3/1875 | Smith et al. | 292/281 |
| 1,834,678 | 12/1931 | Bryant | 292/283 |
| 2,536,941 | 1/1951 | Jones | 292/281 X |
| 2,584,575 | 2/1952 | Goldwasser | 292/205 |
| 3,392,555 | 7/1968 | Beaver | 70/56 |
| 3,590,607 | 7/1971 | Beaver | 70/54 |
| 3,695,657 | 10/1972 | Rosen | 292/148 X |
| 3,718,014 | 2/1973 | Delgadillo | 70/56 |
| 3,800,570 | 4/1974 | Kaplan | 70/54 X |
| 3,961,816 | 6/1976 | Mueller | 292/148 |

FOREIGN PATENT DOCUMENTS

| | | | |
|---|---|---|---|
| 969993 | 6/1975 | Canada | 70/54 |
| 64533 | 5/1946 | Denmark | 292/281 |
| 35249 | 7/1922 | Norway | 292/292 |
| 227884 | 1/1925 | United Kingdom | 292/281 |

*Primary Examiner*—William E. Lyddane
*Attorney, Agent, or Firm*—Finnegan, Henderson, Farabow, Garrett & Dunner

[57] ABSTRACT

A guard for protecting the shackle of a padlock used for locking a locking device in the engaged position comprises a U-shaped member having plate limbs, the shackle being received in the space between the limbs to be protected by the limbs against cutting by means of a tool such as a saw, a file or a bolt clipper.

1 Claim, 18 Drawing Figures

GUARDED LOCKING DEVICE

This is a continuation of application Ser. No. 893,968, filed Apr. 6, 1978, now abandoned.

The present invention relates to a locking device comprising a first element and a second element, said first element being arranged to be inserted into said second element in the engaged position of the locking device, a padlock having a shackle, said first element forming a through hole for passing through the shackle to prevent said first element from being withdrawn from said second element, and a guard for preventing access to the shackle with a cutting tool when the shackle is passed through said first element and the padlock is locked in the engaged position of the locking device.

Padlocks are generally considered to be reliable locks, at least if they are of a good make, but they have one weak part, viz. the shackle which can be forced without difficulties by persons who wish to break into the space which has been locked by means of the padlock, the shackle being cut off by means of a saw, a file or a bolt clipper, although the padlock for the rest is sturdy and solid.

In order to keep people from forcing the padlock in this manner there have been proposed guards of different kinds by which the shackle or the padlock in its entirety is enclosed in a box-like device. These prior art guards are often of a complicated construction and cannot be combined with existing locking devices with padlocks without the locking device being substantially reconstructed. The authorized manipulation of the locking device and the padlock is made difficult and cumbersome by the prior art guards.

The primary object of the invention is to provide a guard in locking devices of the kind referred to above which makes forcing of the padlock by means of cutting tools impossible or very difficult.

A further object of the invention is to provide a guard in locking devices of the kind referred to above which can easily be combined with existing locking devices without a radical reconstruction thereof.

A still further object of the invention is to provide a guard in locking devices of the kind referred to above which can be combined with the locking device as a separate unit.

Another object of the invention is to provide a guard in locking devices of the kind referred to above which can be used also where prior art guards cannot be used.

Yet another object of the invention is to provide a guard in locking devices of the kind referred to above which is very easy to manufacture and therefore can be produced at reasonable costs.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, there is provided according to the invention, in a locking device of the kind referred to above the improvement that the guard comprises a U-shaped member with two mutually spaced plate limbs, in the space between which said first element is inserted for location of the shackle between the plate limbs when the padlock is locked with the shackle inserted through the hole in said first element.

The accompanying drawings which are incorporated in and constitute a part of this specification, illustrate embodiments of the invention and, together with the description, serve to explain the principles of the invention.

Figure 1:
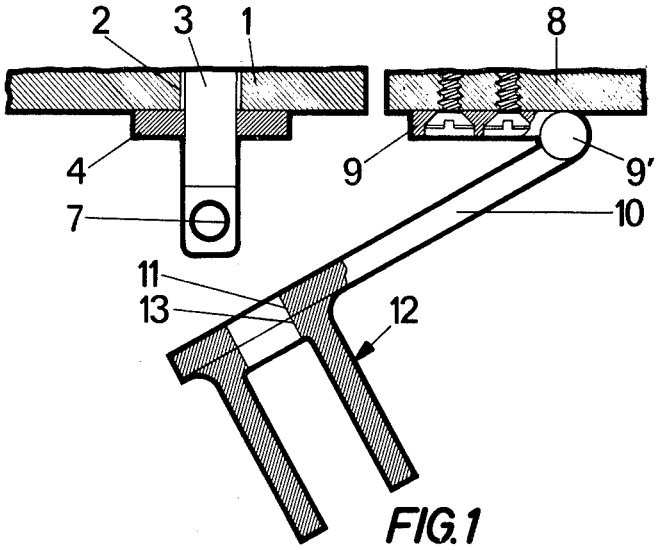
FIG. 1 is a horizontal sectional view of a locking device mounted for locking a door to a wall the locking device being shown in disengaged position.
Figure 2:
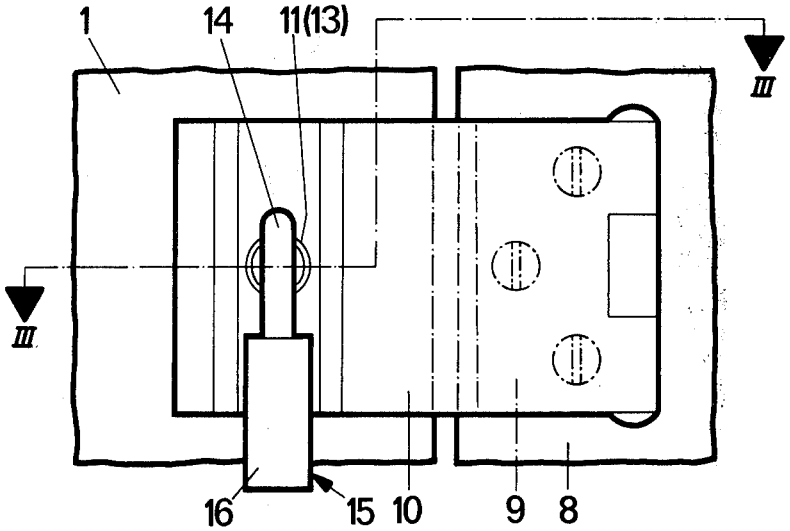
FIG. 2 is a front view of the locking device in FIG. 1 in engaged position.
Figure 3:
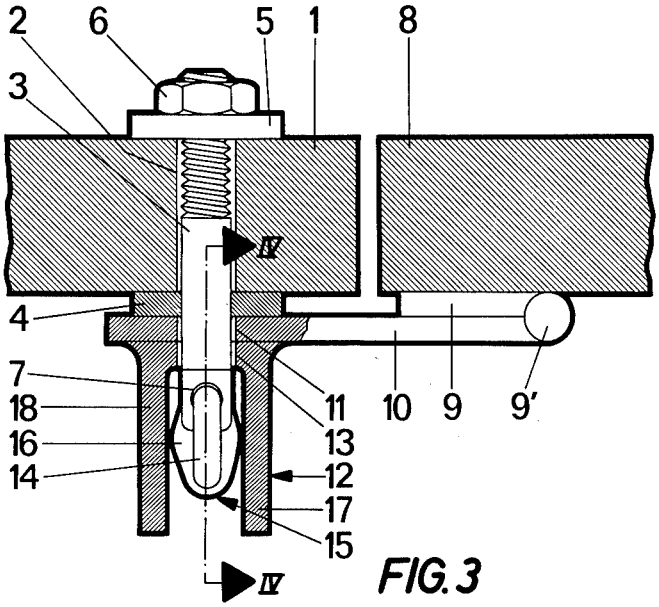
FIG. 3 is a sectional view of the locking device in FIGS. 1 and 2 along line III—III in FIG. 2.

Referring to FIGS. 1 to 4, there is drilled in a door 1 a hole 2 through which there is passed a pin 3 having a washer 4 welded thereto. The pin 3 is secured at the inner side of the door by means of a washer 5 and a nut 6 screwed onto a threaded portion at one end of the pin. In the pin there is formed at the other end thereof a diametrical through hole 7. To a stationary wall 8 there is secured by screws a plate 9 which is pivoted by means of a hinge 9' to a plate 10 having an opening 11. To the plate 10 there is welded a U-shaped member 12 having an opening 13 in the web thereof opposite to opening 11. The door 1 is locked to the wall 8 in the closed position thereof by the plate 10 being threaded over the pin 3 and the shackle 14 of a conventional padlock 15 having a body 16 being passed through the opening 7 to be locked at the body 16.

Figure 4:
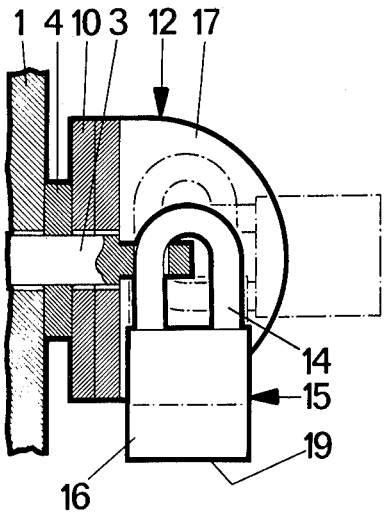
FIG. 4 is a sectional view of the locking device in FIGS. 1 to 3 along the line IV—IV in FIG. 3.

The plate limbs 17 and 18 of the U-shaped member 12 are formed such that the locked padlock 15 in any turned or pivoted position indicated by dash and dot lines in FIG. 4 will have the shackle 14 thereof protected by the limbs 17 and 18 so that the shackle is not available in order to be cut off by means of a saw, a file or bolt clipper. Thus, the member 12 forms a simple guard which protects the locking device from being broken up.

Figure 5:
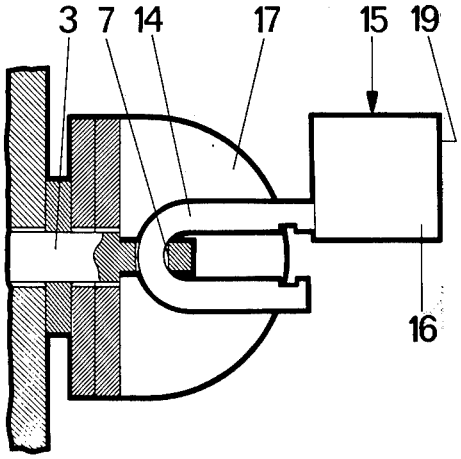
FIG. 5 is a corresponding sectional view as FIG. 4 illustrating the padlock in a position before locking or after unlocking the locking device.

FIG. 5 shows that the invention also provides the possibility to use a padlock of the common type in which the body 16 must be turned about the axis of one limb of the shackle 14 in order to remove the shackle from the pin 3. The key of the padlock in this case is inserted at the end 19 of the body 16.

Figure 6:
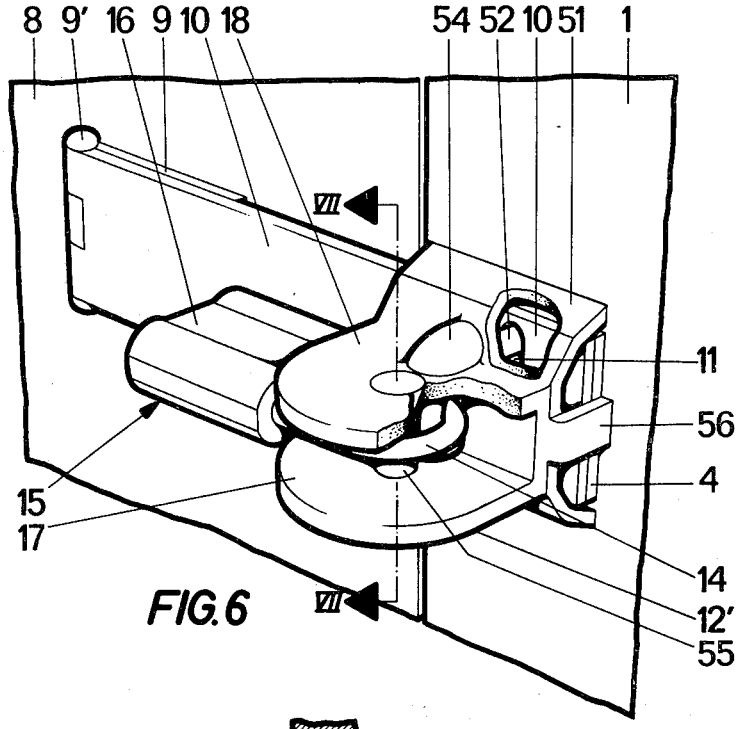
FIG. 6 is a perspective view illustrating the preferred embodiment of the guard according to the invention combined with a locking device of the type disclosed in FIGS. 1–5.
Figure 7:
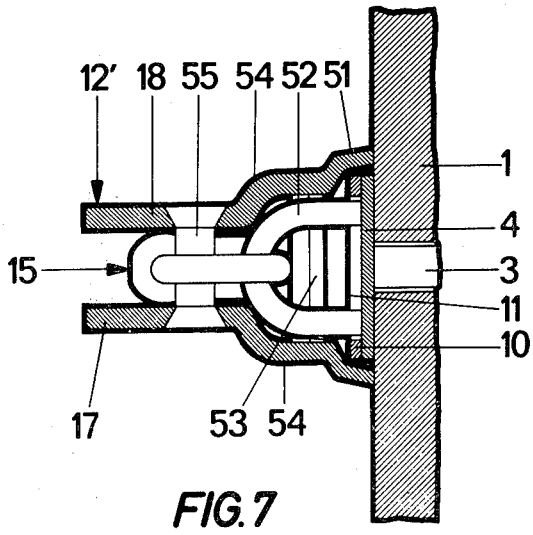
FIG. 7 is a sectional view along line VII—VII in FIG. 6.

The embodiment according to FIGS. 6 and 7 is a modification of the embodiment according to FIGS. 1 to 5 and is considered to be the embodiment presently preferred because the guard, in this case as a separate unit, can be combined with an existing conventional locking device. The U-shaped member in this embodiment is designated 12' and it is provided with a base 51 welded thereto said U-shaped member and said base thereof being loosely located over the plate 10 in a straddling position. The pin 3 does not extend in this case beyond the washer 4; to this washer there is welded a staple 52 which extends through the opening 11 in the plate 10, the form of which is of course adjusted to the staple, and a corresponding opening 53 in base 51 and finally through the opening 13 in the web of the U-shaped member 12'. On the plate limbs 17 and 18 of the member 12' there are formed bulges 54 in order to provide enough space for the staple 52. Between the limbs there extends a cross pin 55 riveted to the limbs, and the shackle 14 of the padlock 15 encloses the staple 52 as well as the cross pin 55. Thereby the member 12' located loosely with the base 51 thereof against the door 1 is maintained in the position shown. Moreover, the cross pin 55 has the important task of preventing the limbs 17 and 18 from being bent out from each other.

The guard comprising the U-shaped member 12' and the base 51 as well as the cross pin 55 preferably is made of a surface hardened steel, and said member preferably is connected to the base by argon arc welding. Due to the fact that the cross pin 55 is riveted in a countersunk fashion, as will be seen from FIGS. 6 and 7, it is not possible to blow off the cross pin.

Preferably there is arranged on the U-shaped member 12' a turned-down flap 56 which prevents the staple 52 from being blown or cut off below the plate 10. A corresponding protection can be obtained by forming the plate 10 with an upturned end flange but it is of course most advantageous to arrange this detail in connection with the guard proper, i.e. member 12'.

In the embodiment according to FIGS. 8 to 11, there is drilled in a door 21 a hole 22. Through this hole there is passed a pin 23 to which there is welded a guard formed by a U-shaped member 24. The pin 23 is connected to the inner side of the door by means of a washer 60 and a nut 25. To a stationary wall 26 there is connected by screws a plate 27 which is pivoted to a plate 28 which forms two elongated openings 29 and 30 in order to be threaded over the plate limbs 31 and 32 of the U-shaped member 24.

The plate 28 is locked to the U-shaped member 24 by means of a pin 33 which passes through openings 34 and 35 of the limbs 31 and 32 and which has, between the limbs, a through diametrical hole 36 through which can be passed the shackle 14 of a padlock 15 said shackle 14 locking the pin 33 to the U-shaped member 24.

If the play between the openings 34 and 35 and the pin 33 is made sufficiently small the pin 33 will render bending of the limbs 31 and 32 of the U-shaped member 24 more difficult.

The limbs 31 and 32 of the U-shaped member 24 are also in this case formed such that the shackle 14 of the padlock 15 is protected in the manner described above in connection with the embodiment according to FIGS. 1–5.

Figure 12:
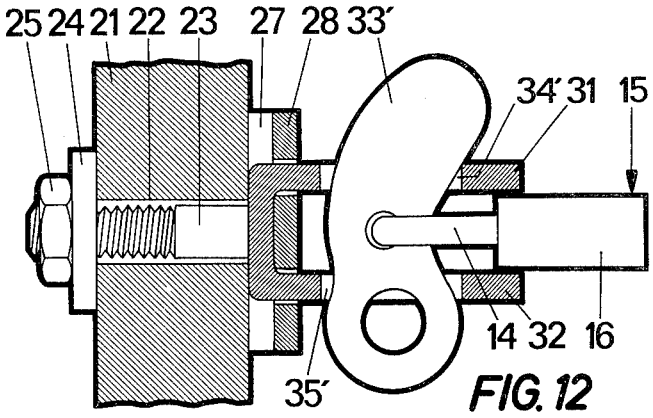
FIG. 12 is a sectional view similar to FIG. 10 of a modified embodiment of the locking device disclosed therein.
Figure 11:
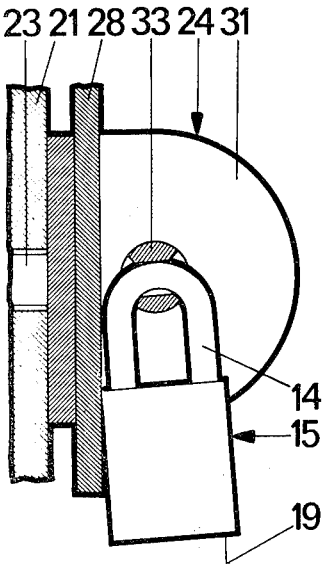
FIG. 11 is a sectional view of the locking device in FIGS. 8–10 along line XI—XI in FIG. 10.
Figure 13:
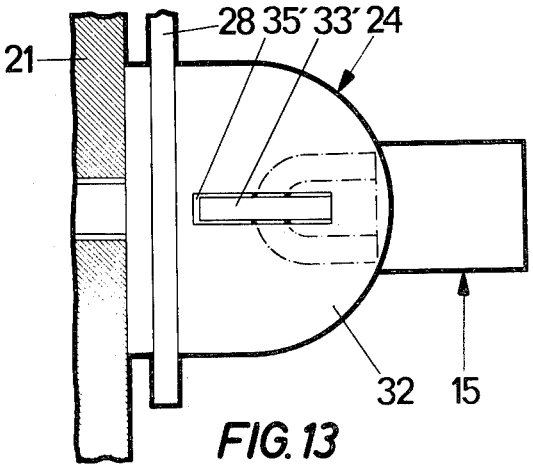
FIG. 13 is a side view of this embodiment.

In the modification according to FIGS. 12 and 13, the pin 33 is replaced by a flat pin 33' made of surface hardened steel sheet having a curved shape the pin being received by slots 34' and 35' in the limbs 31 and 32 and being located with the concave edge thereof facing the outer ends of the limbs 31 and 32. When the padlock 15 is pulled this pin will provide forces against the limbs 31 and 32 providing a tendency of the limbs being bent towards each other such that the distance therebetween is being reduced which still more reduces the possibilities to reach the shackle.

Figure 14:
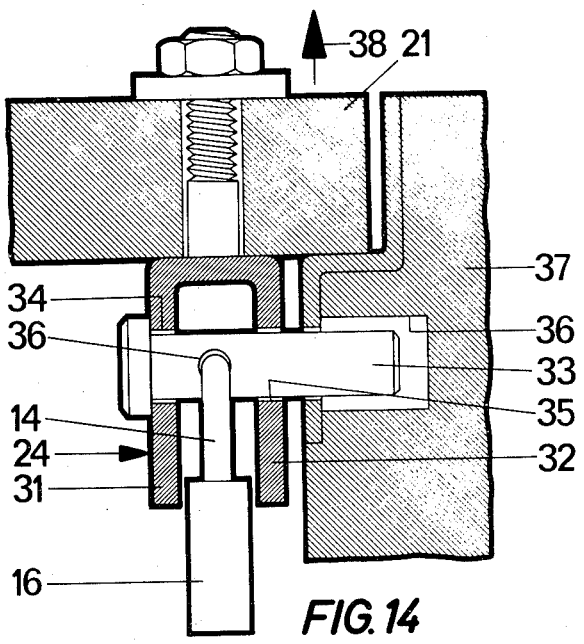
FIG. 14 is a horizontal sectional view of a locking device of a further embodiment for locking a door to a wall.

In the embodiment according to FIG. 14 which is in agreement with the embodiment of FIGS. 8–11 as far as the arrangement of the door 21 is concerned, the pin 33 is extended towards one side and projects into a blind hole 36 in a stationary wall 37 to lock the door 21 to the wall 37. When unlocked the door can be opened in the direction 38. The pin 33 in this case can form part of a push bolt on the door 21.

Figure 15:
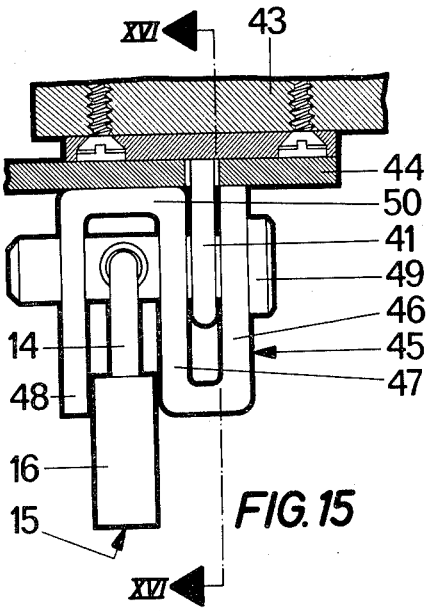
FIG. 15 is a horizontal sectional view, partly a plan view, of a still further locking device with the guard according to the invention.
Figure 16:
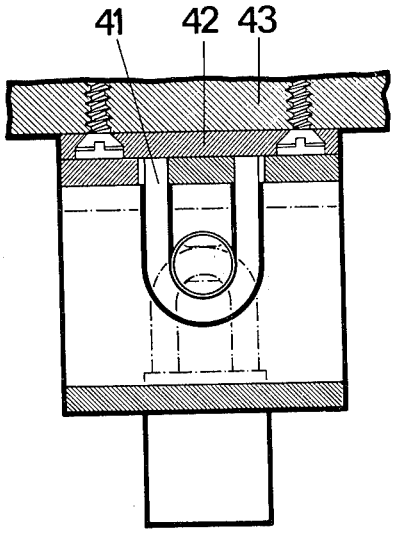
FIG. 16 is a sectional view along line XVI—XVI in FIG. 15.

In the embodiment according to FIGS. 15 and 16 a U-shaped staple 41 is connected to a plate 42 which in turn is connected to a door 43. Over the staple 41 there is threaded a plate 44 which in the same manner as the plates 10 an 28 is connected to a stationary wall. The plate 44 is locked to the plate 42 and the staple 41 by means of a separate S-formed member 45 through the three plate limbs 46 to 48 through which passes a pin 49 formed with a head. The staple 41 is locked to the member 45 between the limbs 46 and 47 by means of the pin 49 which in turn is locked to the member 45 by means of a padlock 15 the shackle 14 of which is passed through a through diametrical hole in the pin, located between the limbs 47 and 48 said limbs thus forming together with the web 50 therebetween the U-shaped member of the guard.

Figure 8:
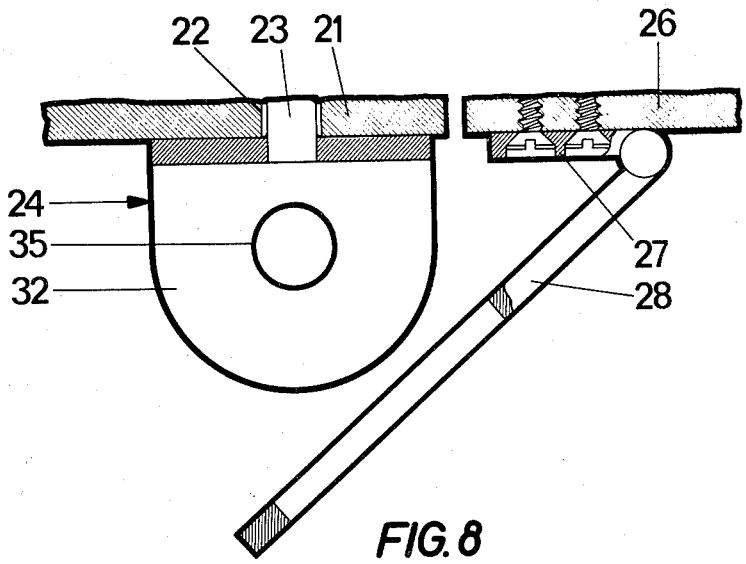
FIG. 8 is a horizontal sectional view of another embodiment of a locking device for locking a door to a wall, the locking device being shown in disengaged position.
Figure 9:
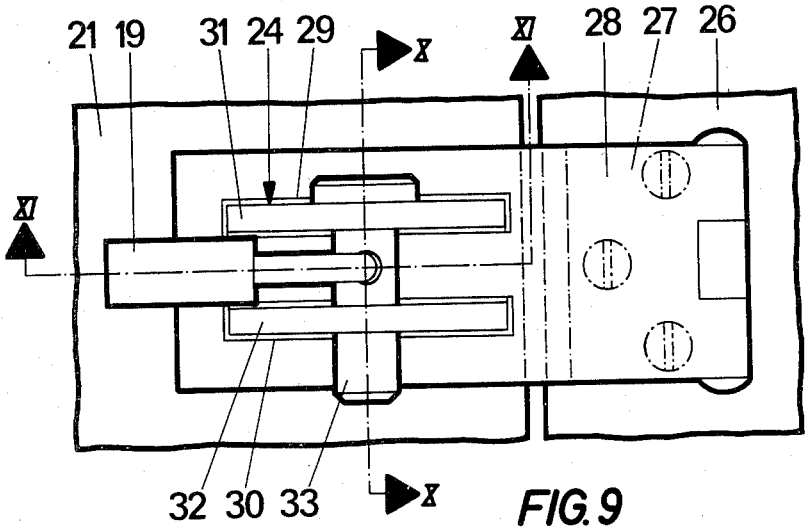
FIG. 9 is a front view of the locking device in FIG. 8 in locked position.
Figure 10:
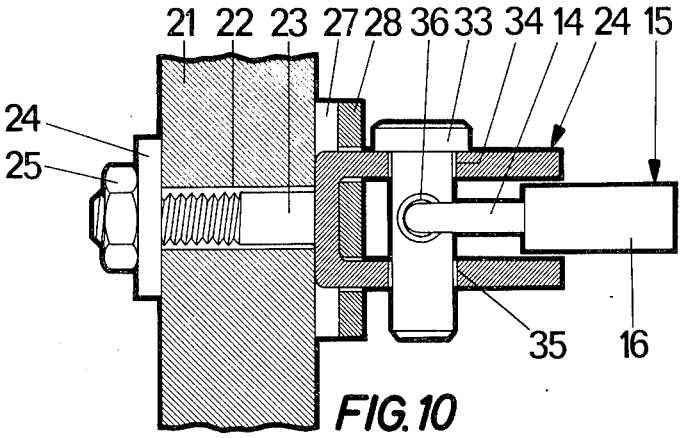
FIG. 10 is a sectional view of the locking device in FIGS. 8 and 9 along line X—X in FIG. 9.
Figure 17:
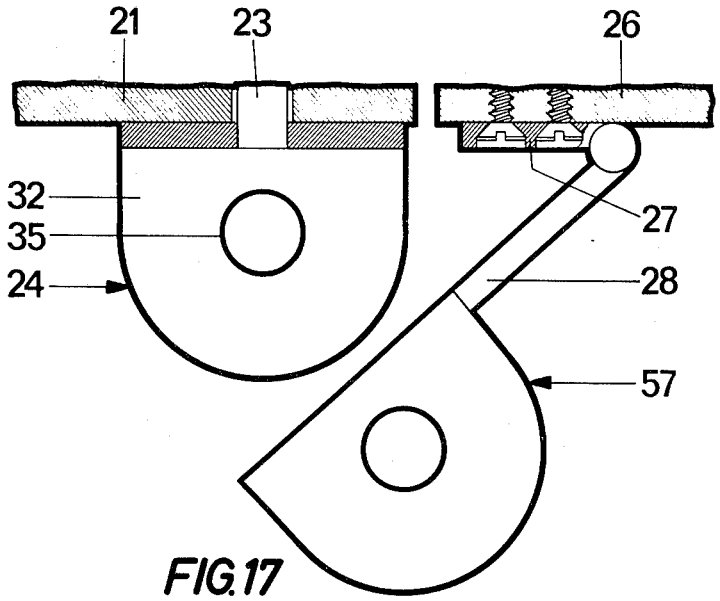
FIG. 17 is a plan view of a further embodiment of a locking device with a guard according to the invention in disengaged position.

In the embodiment according to FIG. 17 there is disclosed a U-shaped member 24 on a door 21 and a pivoted plate 28 on a wall 26 as in FIGS. 8 to 10. However, in this case plate 28 is formed with a U-shaped portion 57 which is received by the U-shaped member 24 between the limbs thereof and is locked to said member by means of the pin 33 and the padlock 15 the pin passing through the plate limbs of the member 24 and the U-shaped portion 57.

In each and every case the padlock 15 should be enclosed by the plate limbs 17 and 18, 31 and 32, 47 and 48, respectively , as closely as possible.

It will be realized that if there is used a padlock in which the body, when the padlock has been unlocked, can be turned about one end of the shackle about an axis which is perpendicular to the plane of the shackle and in which the key of the padlock is inserted into the body in a direction which substantially coincides with the plane of the shackle, the protecting limbs of the guard enclosing the shackle may be made so big that they protect also the body proper of the padlock.

Finally, it should be added that the guard according to the invention can be used in locking devices of other types than those described above. Thus it is for example possible to use the guard on gates in order to prevent the gate from being lifted from the pivot pins thereof the pin 33 shown in FIG. 14 in that case being the pivot pin of the gate connected for example to a gate pole while the U-shaped member 24 is connected to the gate. In the embodiment according to FIGS. 15 and 16 the distance between the limbs 46 and 47 can be made sufficiently large in order to receive two staples or lugs therebetween, which are connected each to one door or one to a door and the other one to a wall. It is also possible to provide the guard in combination with a pin which is adapted to be turned in order to actuate the locking device and to lock the pin in a predetermined pivoted position by means of the padlock.

The invention provides padlock guards as a separate unit or as an integrated part of a locking device, which is of a simple and reliable construction and can easily be manufactured at low costs, affording great safety against cutting off the shackle of the padlock.

It will be apparent to those skilled in the art that various modifications and variations could be made in the guard and the guarded locking device of the invention without departing from the scope or spirit of the invention.

I claim:

1. A guarded locking device for receiving a padlock comprising:

a U-shaped member having two spaced apart plate limbs with a through opening; and a pin for insertion through said opening, said pin having an aperture therethrough for receiving the shackle of the padlock between said plate limbs in the engaged position of the device and wherein said pin is flat and is curved in the longitudinal direction thereof forming a concave edge and a convex edge to have said concave edge facing the free ends of the limbs of the U-shaped member when the pin is received by the openings in said limbs and further wherein said pin urges the U-shaped limbs together when force is applied to said padlock.

* * * * *

UNITED STATES PATENT AND TRADEMARK OFFICE

CERTIFICATE OF CORRECTION

PATENT NO. : 4,322,102

DATED : March 30, 1982

INVENTOR(S) : Erik I. Lindelom

Figure 18:
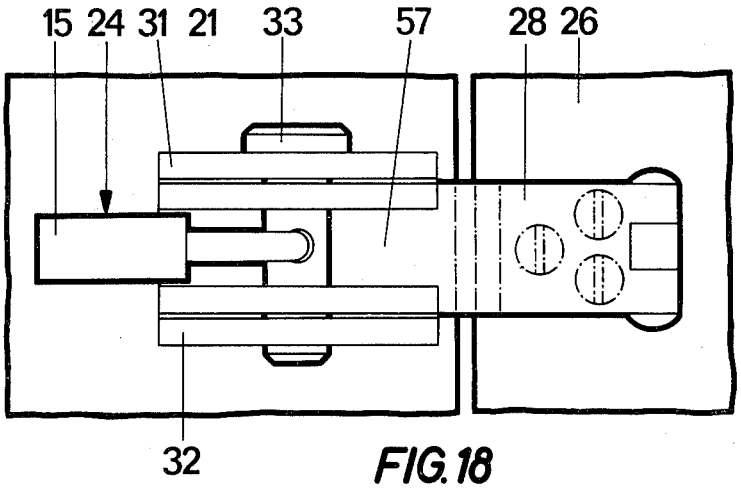
FIG. 18 is a front view of this embodiment in engaged position.
Figure 10:
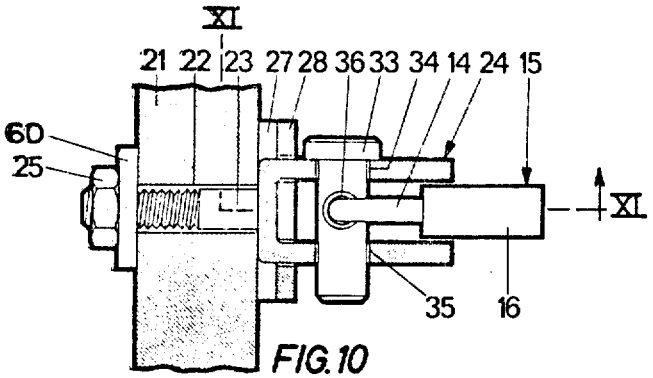
Figure 12:
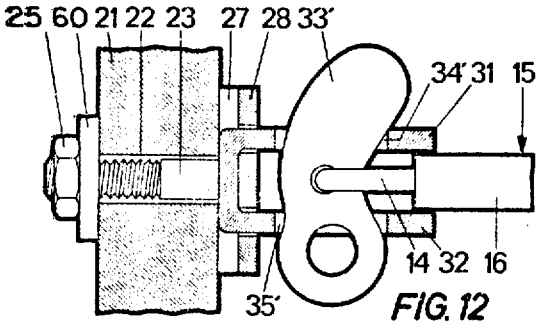
Figure 18:
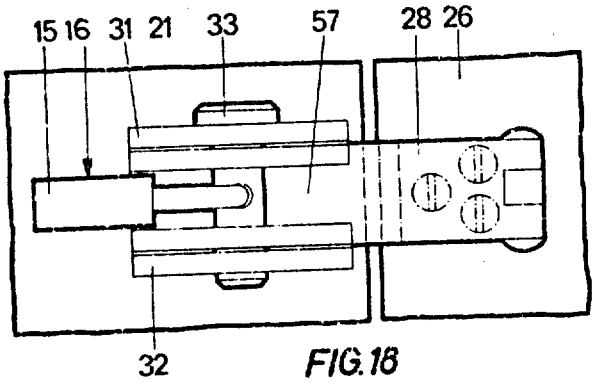

It is certified that error appears in the above—identified patent and that said Letters Patent is hereby corrected as shown below:

Figures 10, 12 and 18 of the drawings should appear as per attached.

Signed and Sealed this

*Fifth* Day of *October 1982*

[SEAL]

*Attest:*

GERALD J. MOSSINGHOFF

*Attesting Officer* *Commissioner of Patents and Trademarks*